US006663539B1

(12) United States Patent
Wu

(10) Patent No.: US 6,663,539 B1
(45) Date of Patent: Dec. 16, 2003

(54) PASSIVE DEVICE FOR EXERCISING LEGS OF A USER THEREOF

(76) Inventor: Dong-Her Wu, No, 141 Chang Shui Road, Sec. 2, Pu Yen Hsiang, Chang Hua Hsien (TW)

( * ) Notice: Subject to any disclaimer, the term of this patent is extended or adjusted under 35 U.S.C. 154(b) by 93 days.

(21) Appl. No.: 10/104,666

(22) Filed: Mar. 25, 2002

(51) Int. Cl.[7] ..... A63B 22/04; A63B 21/00
(52) U.S. Cl. ..... 482/52; 482/57; 601/36
(58) Field of Search ..... 482/57–65, 51, 482/37; 601/23, 27, 29, 34–36

(56) References Cited

U.S. PATENT DOCUMENTS 1,909,002 A * 5/1933 Oehlberg ..... 482/62
4,798,379 A * 1/1989 Jenkins ..... 482/53
4,842,268 A * 6/1989 Jenkins ..... 482/53
4,852,269 A * 8/1989 Glorioso ..... 34/376
5,044,627 A * 9/1991 Huang ..... 482/62
5,199,932 A * 4/1993 Liao ..... 482/53

* cited by examiner

*Primary Examiner*—Stephen R. Crow
(74) *Attorney, Agent, or Firm*—Harrison & Egbert

(57) ABSTRACT

A leg-exercising device includes a base, two support frames mounted on the base, a motor located between the support frames, a transmission gear mounted on a drive axle and actuated by the motor, two sprocket wheels mounted at two ends of the drive axle, two driven chains driven by the sprocket wheels, and two footrests fastened respectively to the driven chains such that the footrests move up and down at such time when the motor is in operation, thereby bringing about a training effect on the legs of a person standing on the footrests.

2 Claims, 5 Drawing Sheets

PASSIVE DEVICE FOR EXERCISING LEGS OF A USER THEREOF

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise device, and more particularly to a leg-exercising device.

BACKGROUND OF THE INVENTION

Conventional leg-exercising devices are generally cumbersome and are not adapted to serve as an adjunct to the physical therapy for rehabilitating a person's legs under treatment.

BRIEF SUMMARY OF THE INVENTION

The primary objective of the present invention is to provide a leg-exercising device which is compact and suitable for use in a limited floor space.

It is another objective of the present invention to provide a leg-exercising device which is adapted to rehabilitate a person's legs under treatment.

In keeping with the principle of the present invention, the foregoing objectives of the present invention are attained by a passive exercise device comprising a base on which two support frames, a motor, a transmission unit, and two driving units are mounted. Two footrests are driven by the two driving units to move up and down along the support frames, so as to bring about a training effect on a person's legs resting on the footrests. The person does not exert a force to activate or operate the exercise device.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
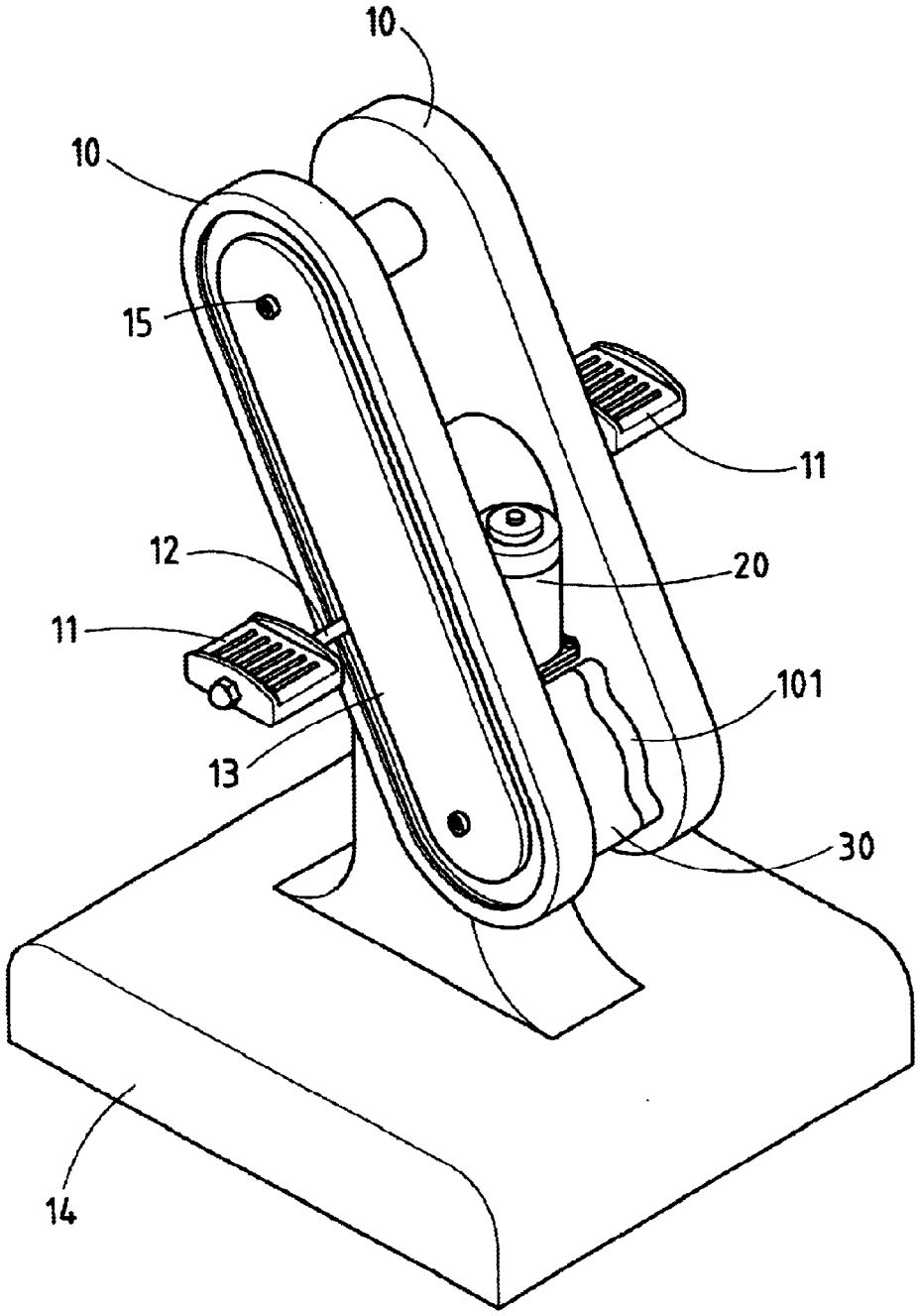
FIG. 1 shows a perspective view of the preferred embodiment of the present invention.

As shown in FIGS. 1–5, an exercise device embodied in the present invention comprises a base 14, two support frames 10, a motor 20, a transmission gear 33, a drive axle 34, two sprocket wheels 16, two driven chains 17, and two footrests 11.

The two support frames 10 are identical in construction with each other and are mounted on the base 14 side by side. The support frames 10 are provided at the bottom end with a fastening hole 102 for fastening a seat 101.

The motor 20 is fastened with a motor mount 30, which is located between the two support frames 10. The motor mount 30 is provided with a horizontal through hole 31 corresponding in location to the fastening holes 102 of the two support frames 10. The motor mount 30 is further provided with a fastening plate 22 which is in turn provided with a vertical through hole 23 in communication with the horizontal through hole 31 of the motor mount 30. The motor 20 is provided with a locating plate 22 by means of which the motor 20 is mounted on the fastening plate 22 such that a motor spindle 21 is received in the vertical through hole 23. A deceleration gear 211 is fastened to the free end of the motor spindle 21. The motor mount 30 is fastened with the seats 101 of the support frames 10 by a plurality of screws 41.

Figure 4:
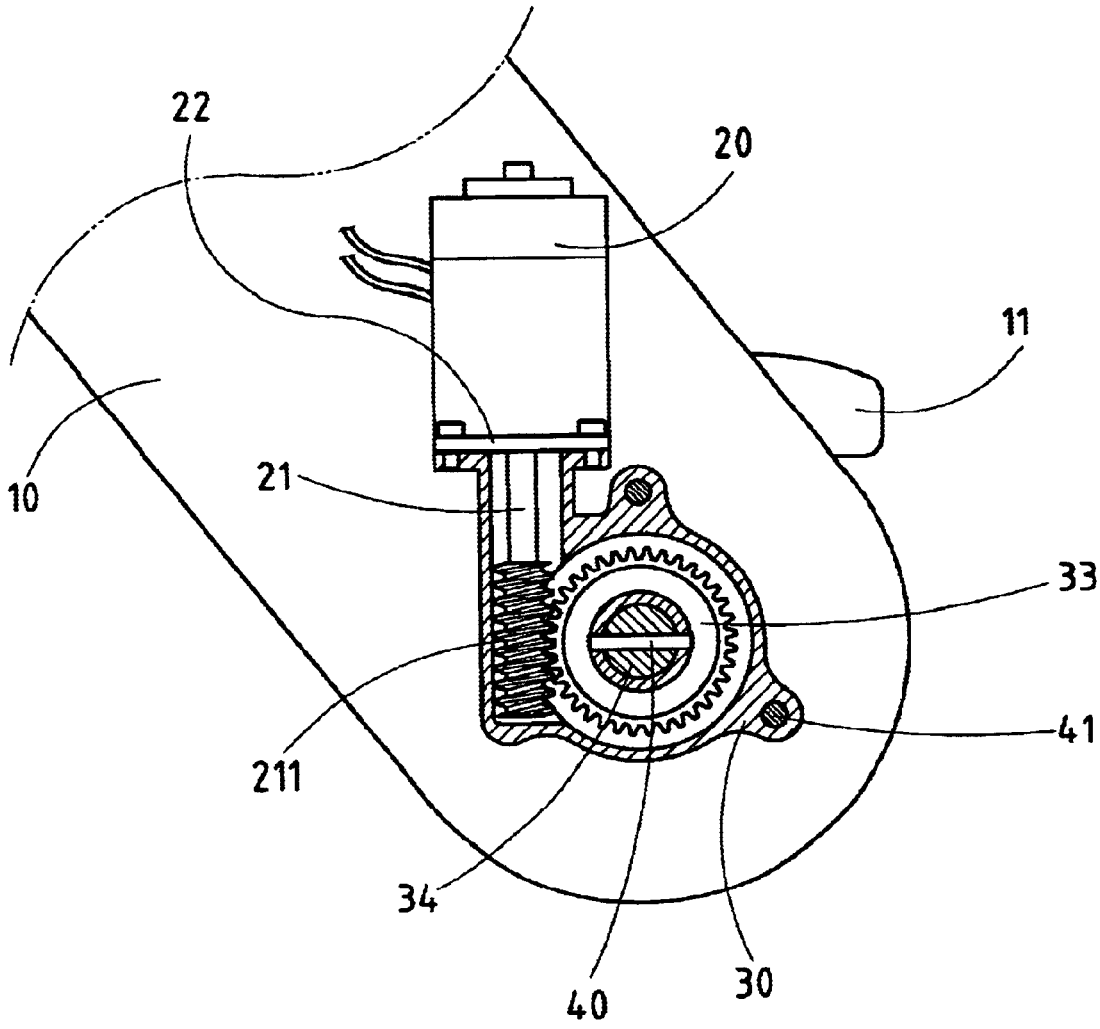
FIG. 4 shows a sectional schematic view of the preferred embodiment of the present invention in action.
Figure 5:
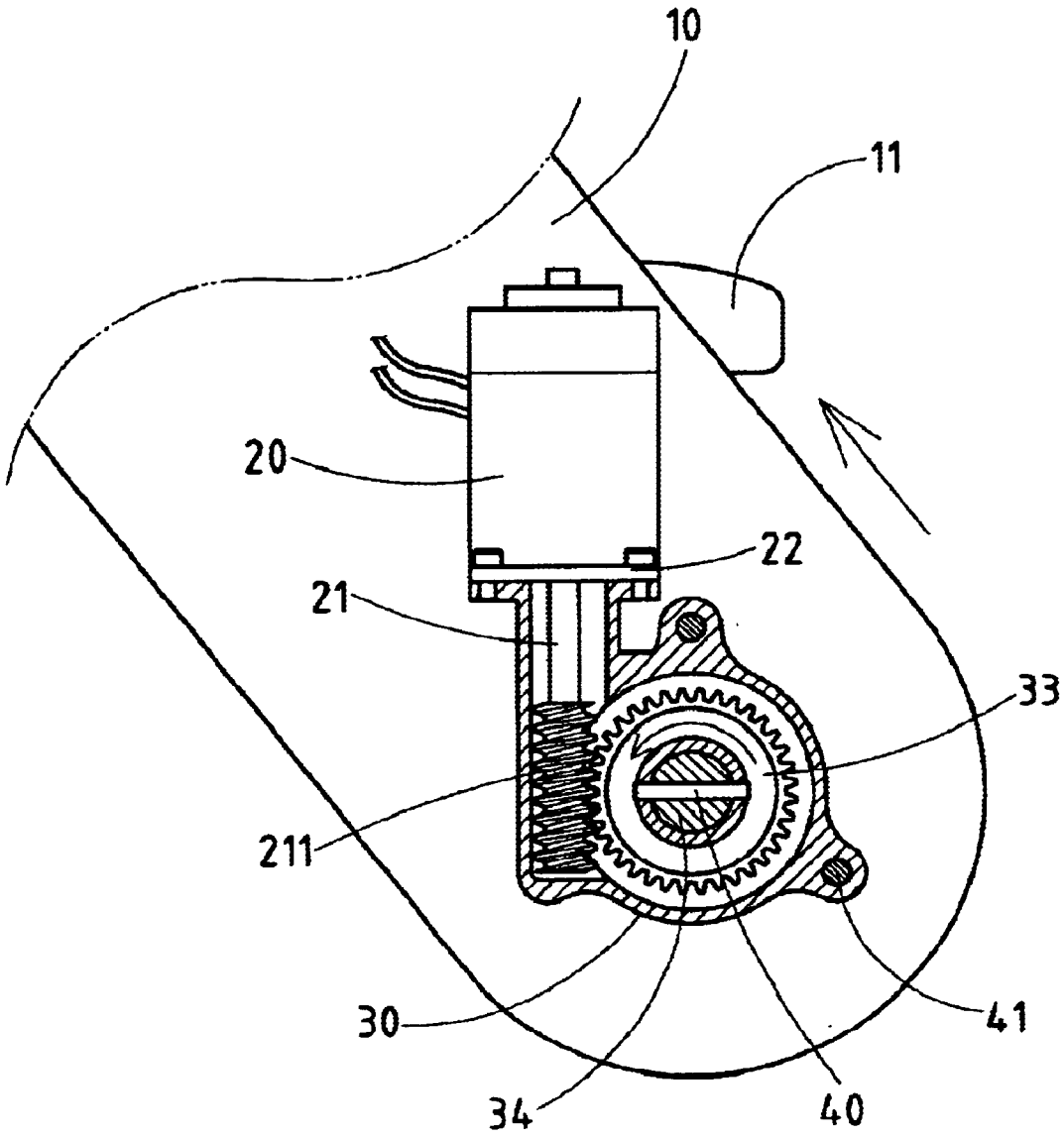
FIG. 5 shows another sectional schematic view of the preferred embodiment of the present invention in action.

The transmission gear 33 is provided with a plurality of locating holes 332 and an axial hole 331 by which the transmission gear 33 is mounted on a drive axle 34. The transmission gear 33 is located on the drive axle 34 by two locating bolts 40 which are received in the locating holes 332. The transmission gear 33 is received in the horizontal through hole 31 of the motor mount 30 such that the transmission gear 33 is engaged with the deceleration gear 211 of the motor spindle 21, as shown in FIGS. 4 and 5. The drive axle 34 is provided at both longitudinal ends with a retaining block 341 and a threaded hole 342.

Figure 2:
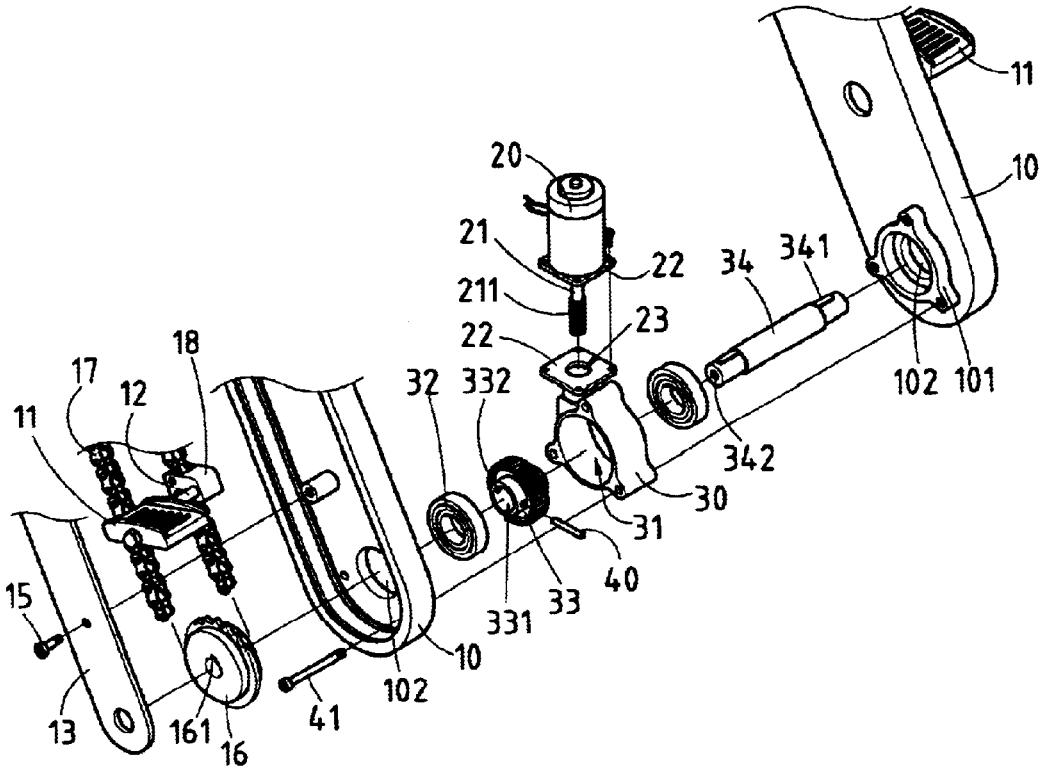
FIG. 2 shows an exploded view of the preferred embodiment of the present invention.
Figure 3:
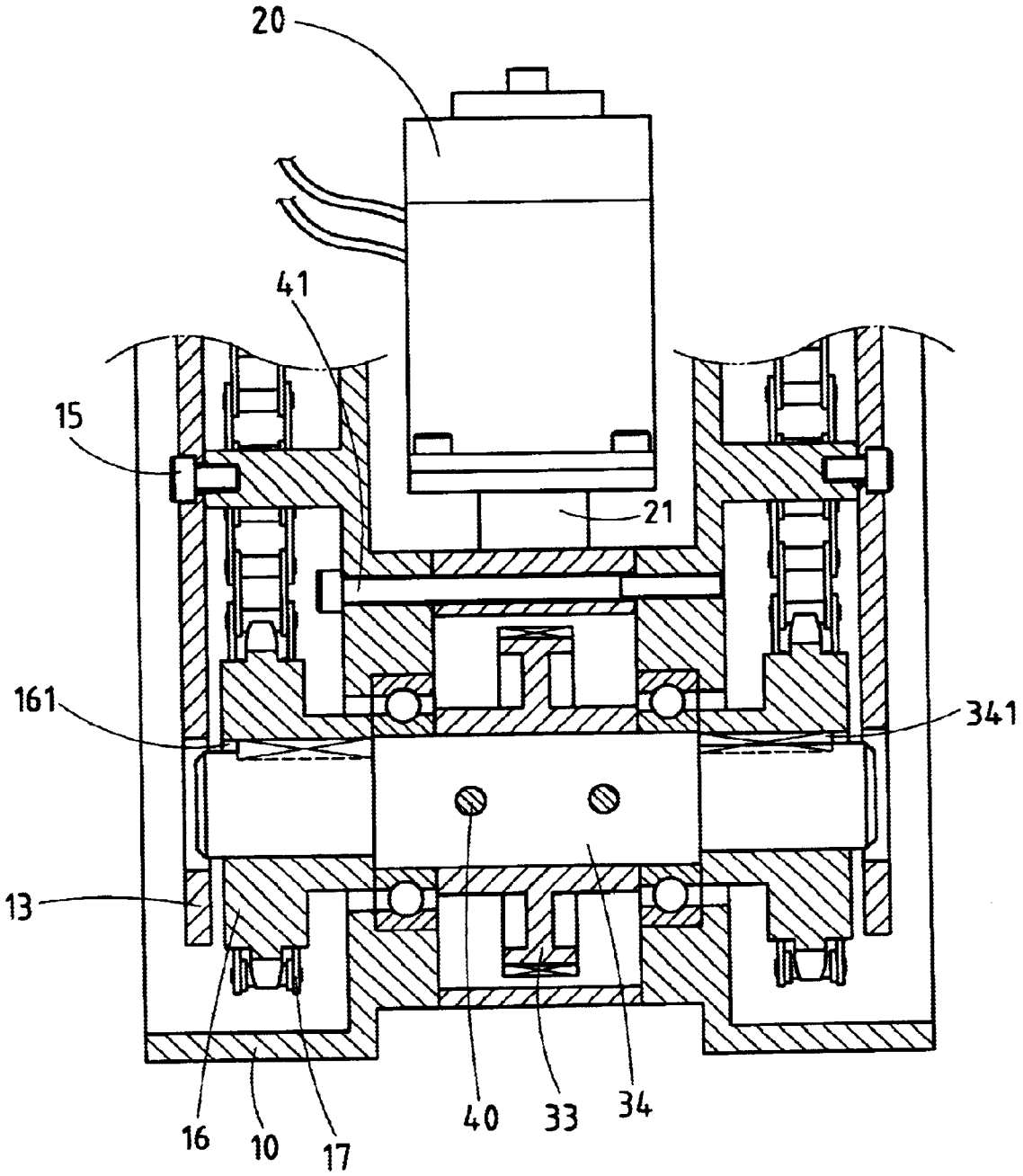
FIG. 3 shows a sectional view of the preferred embodiment of the present invention.

The two sprocket wheels 16 are provided with a center through hole 161 by which the sprocket wheels 16 are mounted on both ends of the drive axle 34 in conjunction with two bearings 32. The two sprocket wheels 16 are actuated by the drive axle 34 to drive the driven chains 17. The two footrests 11 are respectively fastened with the driven chains 17 such that the footrests 11 are driven to move up and down along the support frames 10. The footrests 11 is provided with a connection rod 12 and a fastening block 18 which is fastened to the connection rod 12 for fastening the footrest 11 to the driven chain 17, as shown in FIG. 2.

The support frames 10 are provided with a cover 13, which is fastened to the support frame 10 by a plurality of fastening screws 15. The cover 13 is intended to conceal the sprocket wheels 16 and the driven chains 17, as shown in FIG. 1.

As the motor 20 is started, the transmission gear 33 is actuated by the deceleration gear 211 of the motor spindle 21. The motion is then imparted to the drive axle 34 from the transmission gear 33, thereby causing the two sprocket wheels 16 to turn so as to drive the driven chain 17. As a result, the footrests 11 are caused by the driven chains 17 in motion to move up and down along the support frames 10. The up-and-down movement of the footrests 11 serves to bring about a training effect on a person's legs resting on the footrests 11. The present does not exert a force to activate or operate the exercise device of the present invention. The exercise device of the present invention is thus adapted to rehabilitate a person's legs under treatment.

I claim:

1. An exercise device comprising:

a base;

two support frames mounted side by side on said base and comprised of, at a bottom end, a fastening hole;

a motor mount located between said two support frames such that said motor mount is fastened to said fastening hole of said support frames, said motor mount comprised of a horizontal through hole and a fastening plate which is provided with a vertical through hole in communication with said horizontal through hole;

a motor comprising a spindle, said spindle comprised of, at a free end, a deceleration gear fastened thereto, said motor being mounted on said fastening plate of said motor mount such that said spindle of said motor is received in said vertical through hole;

a transmission gear mounted on a drive axle and located in said horizontal through hole of said motor mount such that said transmission gear is engaged with said deceleration gear of said spindle of said motor, and that said transmission gear is actuated to turn via said deceleration gear by said motor in operation;

two sprocket wheels mounted at two longitudinal ends of said drive axle in conjunction with a bearing such that said two sprocket wheels are driven to turn by said drive axle at such time when said motor is started, said two sprocket wheels being located respectively in said support frames;

two driven chains driven respectively by said sprocket wheels; and two footrests comprised of a connection rod by which said footrests are respectively fastened to said driven chains, thereby enabling said footrests to move up and down to bring about a training effect on the legs of a person standing on said footrests at such time when said motor is in operation.

2. The exercise device as defined in claim 1, wherein said two support frames are comprised of a cover fastened thereto for concealing said sprocket wheels and said driven chains.

* * * * *